United States Patent [19]

Ellis et al.

[11] 4,041,626

[45] Aug. 16, 1977

[54] APPARATUS FOR PRESENTING READING MATTER AS A LINEAR BOOK

[76] Inventors: John Ellis, Dunmore East, County Waterford; Liam Dunne, Sweetbriar, Tramore, County Waterford, both of Ireland

[21] Appl. No.: 524,898

[22] Filed: Nov. 18, 1974

[30] Foreign Application Priority Data

Nov. 28, 1973 United Kingdom ..... 55050/73

[51] Int. Cl.[2] ..... B65H 19/02

[52] U.S. Cl. ..... 40/86 R; 242/67.4; 242/71.2

[58] Field of Search ..... 242/67.3, 67.4, 71.2, 242/199, 55; 35/35 G, 35 B, 35 R, 35 E, 35 H; 40/347, 343, 117, 106.1, 86 A, 86 R

[56] References Cited

U.S. PATENT DOCUMENTS

| | | | |
|---|---|---|---|
| 3,316,668 | 5/1967 | Rogers | 40/117 |
| 3,479,985 | 11/1969 | Morley | 40/86 R |
| 3,522,672 | 8/1970 | Hinds | 40/86 R |

FOREIGN PATENT DOCUMENTS

| | | | |
|---|---|---|---|
| 805,251 | 8/1936 | France | 40/86 R |
| 951,541 | 3/1964 | United Kingdom | 40/86 R |

*Primary Examiner*—George F. Mautz
*Attorney, Agent, or Firm*—Norris & Bateman

[57] ABSTRACT

A linear book comprising a transparent holder formed with two rectangular bodies extending between two semi-cylindrical end members housing spindles on which pages of the book in ribbon or roll form are wound and a similar transparent closure member hinged to one of the end members of the holder to enclose the ribbon or roll with knurled end caps on the end members engaging the spindles to draw the pages between the transparent bodies for display and clips on the closure member engaging sockets on the holder to fasten the closure member to the holder in the closed position.

3 Claims, 5 Drawing Figures

APPARATUS FOR PRESENTING READING MATTER AS A LINEAR BOOK

This invention relates to improvements in apparatus for presenting reading matter as a linear book for perusal by persons who, because of physical handicaps, advanced age or other physical disabilities, are unable to manually support a book with ease and comfort because of its structural weight, stiff binding, frequent large size, and other physical features common to printed, bound books.

Further, this invention is of particular usefulness to readers of scholastic, instructional and textbooks in the educational field, because of its elimination of the inflexible bindings often found in such books. Readers are relieved of having to hold the pages open, thus freeing both hands for writing, drawings or other related matters.

An advantage in this invention of considerable importance to book publishers and book manufacturers is the considerable saving in production costs, which in the publishing industry have reached high levels. These levels are due to many factors which have to be carefully considered in this field. They are in brief, the costs of book papers, binding cloths, typesetting either manually or machine composition, electronic and photocomposition, labour, and the train of operations through which a book must proceed from the typed manuscript to the final bound volume; namely, design, typesetting, sheetwork (folding, tipping, gathering, sewing); forwarding (back glueing and trimming, backing, headbanding, and lining); finishing (casemaking, stamping, casing-in, inspecting, packing and shipping), and other side operations.

The object of the present invention is to obviate these operations by producing a linear book on the two sides of a ribbon or roll of paper on each side of which one half of the total number of pages of a book are printed, inclusive of front and-back matter; that is to say; title and introductory pages in the front; and index., references etc. including colophon, in the back. Both sides of the ribbon of paper are printed in pages with top, bottom and side margins, the ribbon of paper being connected to and rolled upon a spindle which is then placed in a transparent plastics holder, through which the book is read page by page while transporting the paper ribbon across the body of the holder to a second take-up spindle, by turning a knurled knob at the end of the holder.

According to the invention apparatus for presenting reading matter as a linear book comprises a holder for the ribbon or roll formed with a substantially rectangular body of a transparent rigid plastics material connecting two semi-cylindrical hollow end members, a closure member or door formed with a substantially rectangular body of a transparent rigid plastics material connecting two semi-cylindrical hollow end members one of the end members of the closure member or door being hinged to one of the end members of the holder, integral circular caps on one end of each of the semi-cylindrical end members of the holder, spindles for receiving the ribbon or roll rotatably mounted in each end member to which the ends of the ribbon or roll are removably affixed and means for winding the ribbon or roll through the body from one spindle to the other to display the ribbon or roll as pages of a Linear Book visible through the body.

The invention will be described with reference to the accompanying drawings.

Figures 1, 2:
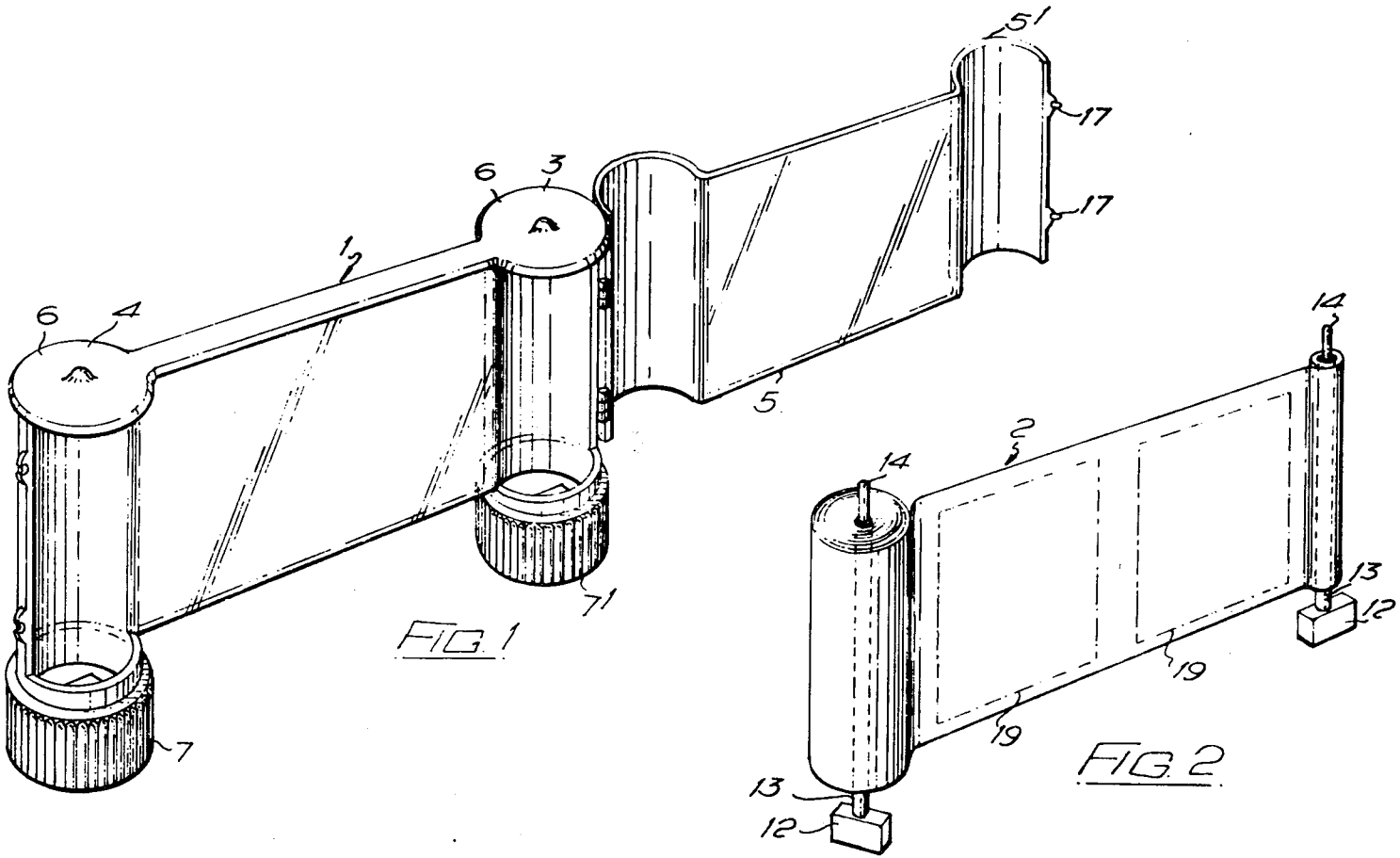
FIG. 1 is a perspective view of a holder, for a printed paper ribbon or roll, in the open position.
FIG. 2 is a perspective view of the ribbon on two spindles for insertion in the holder.
Figure 3:
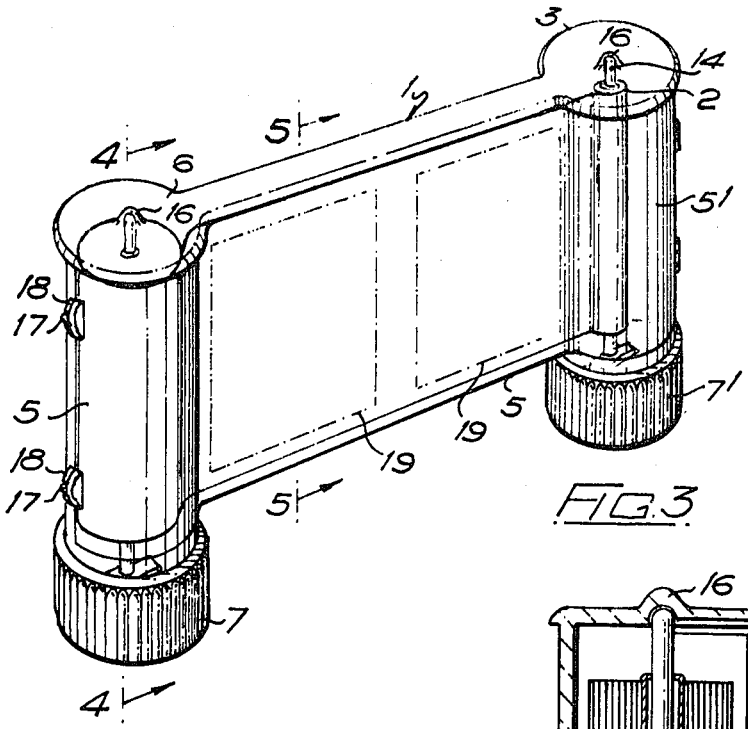
FIG. 3 is a perspective view of the holder with a ribbon therein.
Figure 5:
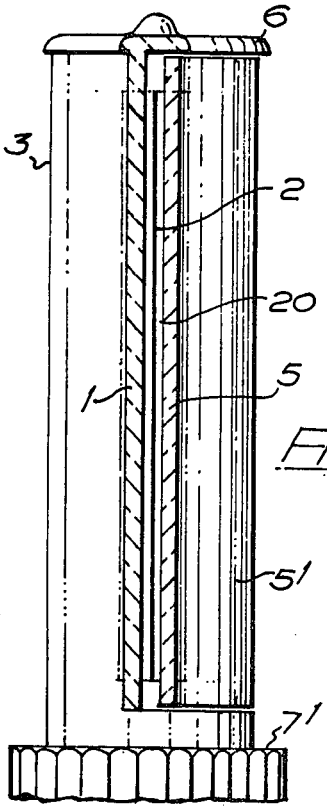
FIG. 5 is a vertical section on line 5—5 FIG. 3.
Figure 4:
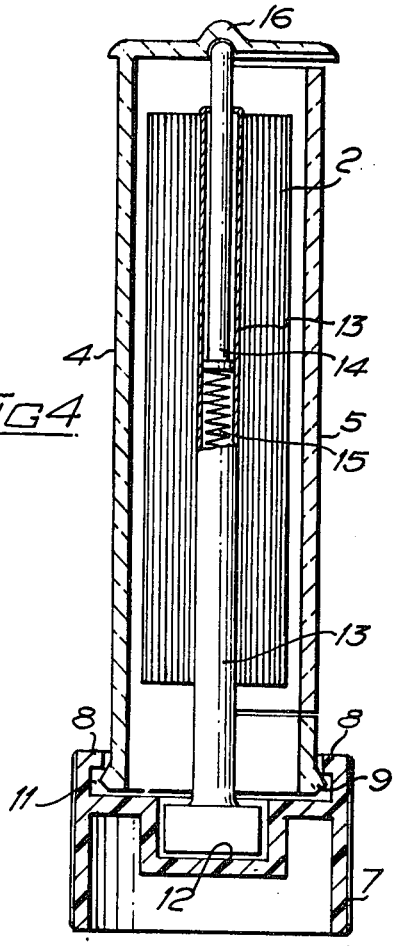
FIG. 4 is a vertical section on line 4—4 FIG. 3.

A holder for a paper ribbon or web 2 is formed with a substantially rectangualr body 1 of a transparent rigid plastics material connecting two semi-cylindrical hollow end members 3,4 and with a closure member or door 5 having a substantially rectangular body hinged to one of the end members 3 as shown in FIG. 1 similar cylindrical end members 5[1] being provided on the body 5 of the closure member or door.

The end members 3,4 are each formed with a circular integral cap 6 to close one end and are open at the opposite end. The open ends are closed by a knurled cylindrical cap 7, 7[1], formed with an inwardly extending flange 8 to spring over a rib 9 formed around the open end of the cylindrical member.

A recess 11 is provided in the cap 7 into which the end of the cylindrical member is sprung, the rib 9 tapers outwards from the periphery of the cylindrical member at an angle of 30° and upwards from the end of the member at an angle of 45° to facilitate the applications and withdrawal of the cap.

The recess 11 is deepened centrally to form a recess 12 in the cap to house the enlarged end 12 of a spindle 13, the head 12 being in frictional control with the periphery base of the groove 12 so that the spindle may be rotated with the cap.

The spindle is constructed as a tube 13 separated from a rod 14 by a spring 15. The free end of the rod 14 is housed in a bearing recess 16 formed in the integral cap 6.

One end of the ribbon or roll 2 of paper is affixed in known manner to one spindle 13 and is wound thereon, the spindle being then inserted with the end member 3 to engage the bearing recess 16 in the cap 6 with the free end of the ribbon or roll extending along the body 1 of the holder and affixed to the second spindle 13 in the end member 4. The closure member or door 5 is then closed, clips 17 on one end member of the closure member or door 5 engaging sockets 18 on the end member 4 with a page or pages 19 of the paper extending through a narrow space 20 between the bodies 1, 5. By turning the knurled knob 7 the ribbon or roll 2 is transferred through the body one or more pages 19 at a time for reading through the transparent body 1. When the ribbon or roll has been wound onto the spindle on the end member 4 the holder is reversed and the letterpress on the reverse side of the pages 19 is readable and the ribbon or roll is re-wound onto the spindle in the end member 3 by rotation of the knurled knob 7[1] and the holder may then be re-opened and the ribbon or roll exchanged for a further ribbon or roll.

What we claim is:

1. Apparatus for presenting reading matter on the two sides of a web of paper or the like comprising a holder having a substantially rectangular body member of transparent rigid plastics material provided at opposite ends with part-cylindrical hollow end members, a closure having a substantially rectangular body of transparent rigid plastics material provided at opposite ends with part-cylindrical hollow end members, means pivotally connecting one of said closure end members with one of said body end members whereby said closure may be moved between a holder open position and a holder closed position wherein said transparent body members are in opposed adjacent relation to define a narrow space between them and said end members cooperate to define parallel cylindrical chambers at opposite ends of that space, spindles upon which opposite ends of said web are secured, each of said holder body end members having one lateral open-mouthed end, each of said spindles having an end extended through its body member open-mouthed end, and means detachably rotatably mounting said spindles in the body end members comprising a pair of caps, closing each open-mouthed end, means formed on each said cap and the periphery of its corresponding open-mouthed end of one of said holder body end members for freely, rotatably mounting the cap thereon, and coacting interfitting means on said caps and the adjacent extended ends of the spindles for non-rotatably interconnecting each said cap with a spindle, whereby a web wound as a roll on one of said spindles in the chambers of the closed holder may be traversed through said space to read the matter on one side and then reversely traversed through said space to read the matter on the opposite side.

2. The apparatus defined in claim 1, wherein said coacting interfitting means on said caps and the adjacent extended ends of the spindles comprise internal recesses formed in said caps and enlarged frictionally fitting formations on said spindles.

3. The apparatus defined in claim 1, wherein said body end members are closed by integral caps at the ends opposite said rotatable caps, and said spindles extend between said caps.

* * * * *